US008630151B2

(12) United States Patent
Casagrande et al.

(10) Patent No.: US 8,630,151 B2
(45) Date of Patent: Jan. 14, 2014

(54) RADIO-SYNCHRONOUS SIGNAL RECEIVER FOR ADJUSTING A TIME BASE, AND METHOD FOR ACTIVATING THE RECEIVER

(75) Inventors: Arnaud Casagrande, Bole (CH); Carlos Velasquez, Neuchatel (CH); Emil Zellweger, Lommiswil (CH)

(73) Assignee: The Swatch Group Research and Development Ltd, Marin (CH)

( * ) Notice: Subject to any disclaimer, the term of this patent is extended or adjusted under 35 U.S.C. 154(b) by 534 days.

(21) Appl. No.: 12/887,137

(22) Filed: Sep. 21, 2010

(65) Prior Publication Data

US 2011/0070851 A1 Mar. 24, 2011

(30) Foreign Application Priority Data

Sep. 22, 2009 (EP) ..... 09170980

(51) Int. Cl.
*G04C 13/00* (2006.01)

(52) U.S. Cl.
USPC ..... 368/47; 368/56

(58) Field of Classification Search
USPC ..... 368/46–47, 55–56
See application file for complete search history.

(56) References Cited

U.S. PATENT DOCUMENTS

| | | | | |
|---|---|---|---|---|
| 3,803,828 | A * | 4/1974 | Keeler et al. | 368/87 |
| 4,921,467 | A * | 5/1990 | Lax | 455/264 |
| 6,704,554 | B1 | 3/2004 | Gerrits | |
| 7,983,116 | B2 * | 7/2011 | Fujisawa | 368/47 |
| 2006/0023572 | A1 | 2/2006 | Someya | |
| 2009/0185615 | A1 | 7/2009 | Someya | |

FOREIGN PATENT DOCUMENTS

| | | | |
|---|---|---|---|
| DE | 3540380 | A1 | 5/1987 |
| EP | 1630960 | A1 | 3/2006 |
| EP | 1666995 | A2 | 6/2006 |
| EP | 1698950 | A1 | 9/2006 |
| WO | 2006/054576 | A1 | 5/2006 |

OTHER PUBLICATIONS

European Search Report for EP 09170980, dated Feb. 12, 2010.

* cited by examiner

*Primary Examiner* — Sean Kayes
(74) *Attorney, Agent, or Firm* — Sughrue Mion, PLLC

(57) ABSTRACT

The receiver (1) is for receiving radio-synchronous signals for adjusting the time base of a timepiece. The receiver includes an antenna (2) for receiving radio-synchronous signals, a low noise amplifier (3), connected to the antenna, a frequency conversion unit (7) for converting the frequency of the filtered and amplified incoming signals from the amplifier, and a processing unit (8) receiving data signals (data_out) from the conversion unit for adjusting the time base. The conversion unit includes a local oscillator stage (10) with a quartz (12) for supplying oscillating signals (Sm) at a determined frequency, a mixer unit (4) for mixing the incoming signals with the oscillating signals from the oscillator stage to generate intermediate signals (IF), a bandpass filter (5) for filtering the intermediate signals (IF), and a demodulator (6) receiving the filtered intermediate signals and supplying the data signals. The local oscillator stage is configured automatically by a control signal (Cm) from the processing unit to adapt the frequency of the oscillating signals (Sm) in accordance with the incoming radio-synchronous signal frequency, so that the intermediate signal (IF) frequency is within the frequency band of the bandpass filter.

15 Claims, 2 Drawing Sheets

RADIO-SYNCHRONOUS SIGNAL RECEIVER FOR ADJUSTING A TIME BASE, AND METHOD FOR ACTIVATING THE RECEIVER

This application claims priority from European Patent Application No. 09170980.8 filed Sep. 22, 2009, the entire disclosure of which is incorporated herein by reference.

FIELD OF THE INVENTION

The invention concerns a radio-synchronous signal receiver for adjusting a time base, particularly for a timepiece, such as a watch. The receiver includes an antenna receiving radio-synchronous signals, at least one low noise amplifier for amplifying and filtering the signals picked up by the antenna, a frequency conversion unit for converting the frequency of the incoming, filtered, amplified signals and a processing unit that receives data signals from the conversion unit for adjusting the time base.

The invention also concerns a method of activating the radio-synchronous signal receiver for adjusting the time base of a timepiece.

BACKGROUND OF THE INVENTION

To regulate a time base automatically, particularly of a timepiece, such as a watch, a VLF multi-frequency receiver is generally clocked on the basis of a timepiece quartz. The same is true for adjusting the resonant frequency of the receiver antenna, which must be able to pick up radio-synchronous signals. The antenna may be formed of a ferrite core around which a metal wire is wound to allow it to pick up such radio-synchronous signals.

A standard radio-synchronous signal receiver, which is incorporated into a watch, is usually a direct receiver for picking up signals, which may have a frequency of close to 77 kHz. The advantages of this type of receiver are simplicity and low power consumption. However, the frequency of the radio-synchronous signals to be picked up may be different from the aforementioned frequency. Consequently, for every radio-synchronous signal frequency that it wants to receive, the receiver has to have an individual filter, in the form of a specific quartz, outside the main integrated circuit of the receiver. This constitutes a drawback of this standard type of receiver.

US Patent Application No. 2009/0185615 discloses a radio-synchronous receiver, which includes a time code for correcting the time base of a watch. This receiver includes a receiver unit for picking up said radio-synchronous signals, which are frequency converted in a mixer by oscillating signals provided by an oscillator circuit. The intermediate signals supplied by the mixer are filtered by at least one bandpass filter. The filtered and amplified intermediate signals are supplied to the time code detection circuit to supply time data to a central processing unit, which decodes the time from the time data to correct the time base. A radio-synchronous signal reception channel is selected in the receiver so as to configure the oscillator circuit. The configured oscillator circuit supplies oscillating signals whose frequency depends on the selected channel frequency of the radio-synchronous signals to be picked up. However, the oscillating signal frequency is not automatically adapted in accordance with the incoming signal frequency so that the frequency of the intermediate signals is within the frequency band of the bandpass filter.

Like the preceding document, U.S. Patent Application No. 2006/023572 discloses a radio-synchronous signal receiver for correcting the time base of a watch. At the receiver input, a frequency selection circuit is controlled by a processing unit to adapt to the frequency of the incoming radio-synchronous signals, which may have a frequency of 40 kHz, 50 kHz or 60 kHz. The incoming signals are frequency converted in a mixer by oscillating signals supplied by a quartz oscillator. With the quartz oscillator frequency set at 50 kHz, it is possible to pick up radio waves at 40 kHz or 60 kHz with intermediate signals at the mixer output at a frequency of around 10 kHz. A bandpass filter at the mixer output can be centred on 10 kHz to filter the intermediate signals. The filtered and amplified signals are then supplied to a detection circuit connected to a demodulator for correcting the time base. If the value of the radio-synchronous signal frequency is the same as the oscillating signal frequency, the processing unit momentarily disconnects the oscillator circuit. However, the oscillating signal frequency is not adapted to adjust automatically the intermediate signal frequency in the frequency band of the bandpass filter in accordance with the incoming radio-synchronous signal frequency.

U.S. Pat. No. 6,704,554 discloses an FM (frequency modulation) receiver, which can be used for receiving RDS signals. This receiver includes an antenna for picking up signals within the FM transmission band between 88 and 108 MHz. The data signal frequency in the incoming signals is around 57 kHz (sub-carrier) for RDS data or 38 kHz for audio data. These data signals cannot, however, correct the time of a time base. A mixer is also provided for frequency converting the signals shaped by an RF input stage by means of oscillating signals supplied by a local oscillator. Intermediate signals at a frequency of around 70 kHz are supplied at the mixer output and are filtered in a bandpass filter and amplified prior to being supplied to a demodulator. An automatic frequency controller is also provided for adapting the frequency of the oscillating signals from the local oscillator to guarantee a constant frequency for the intermediate signals at the mixer output. However, this complex receiver cannot correct the time of a watch time base. Moreover, this receiver is not provided for the purpose of automatically adjusting the frequency of intermediate signals within the bandpass filter frequency band in accordance with the incoming radio-synchronous signal frequency.

The antenna frequency of this standard receiver must also be tuned to the receiving frequency. This operation is performed by external capacitors, which are normally selected during manufacturing steps in accordance with the frequency of the radio-synchronous signals likely to be picked up. These external capacitors also tune the receiving frequency when the receiver is switched on with compensation for tolerances and the capacitors can be switched depending upon the application for which the receiver can be used. All of these adaptation steps with external components are long and expensive, which constitutes another drawback of this standard type of receiver.

Another state of the art receiver that can be cited concerns EP Patent Application No. 1 666 995 A2, which discloses a watch fitted with a radio-synchronous signal receiver for setting the time of the watch. To achieve this, the receiver includes, in particular, an antenna, means for adapting the receiving frequency in conjunction with the antenna, means for receiving signals picked up by the antenna, processing means connected to a memory, which receive a time code signal from the receiving means for setting the time.

The resonant frequency adapting means for receiving radio-synchronous signals is mainly formed of an array of variable capacitance diodes. These variable capacitance diodes can be selectively placed in parallel to the coil-shaped antenna via a control signal supplied by the processing means. The control signal is a function of a capacitive value stored in the memory to select the number of diodes to be placed in parallel to the antenna in accordance with the frequency of the radio-synchronous signals to be picked up. Only a certain number of capacitive values are stored for adapting the antenna reception frequency. This constitutes a drawback, since the resonant frequency of the antenna is not precisely defined for receiving radio-synchronous signals at a determined frequency, in the best possible conditions.

EP Patent Application Nos. 1 630 960 and 1 698 950 also disclose an array of switchable capacitors that can be placed in parallel to the antenna for receiving radio-synchronous signals for adapting the resonant frequency of the antenna. The antenna resonant frequency is thus adapted on the basis of the known frequency of the incoming radio-synchronous signals. The radio-synchronous signals thereby picked up supply time data for correcting the time base of a watch. However, the resonant frequency is not automatically adapted after an incoming radio-synchronous signal frequency measurement to allow proper demodulation of the time data to be carried out.

The receiving means include a variable gain amplifier for amplifying the radio-synchronous signals, a filter for filtering the amplified signals and a detection circuit receiving the filtered signals to supply a time code signal to the processing means. The filter includes several quartz crystals, which can be individually selected in accordance with the frequency of the incoming radio-synchronous signals. The detection circuit also controls the amplifier gain. One drawback of the receiving means is that it has to be fitted with several quartz crystals for the filter so that proper filtering can be performed in accordance with the incoming radio-synchronous signal frequency, which makes the receiver expensive.

We can also cite WO Patent Application No. 2006/054576, which discloses a VHF radio signal receiver. This receiver is arranged in a very flexible manner for assembly with various receiving antennas. To achieve this, two switches, controlled by a control logic circuit, are provided at the input for connecting one or other of the receiving antennas. An array of switchable capacitors is also placed in parallel to one or other of the antennas to be used for adapting the resonant frequency of the selected antenna. One drawback of this receiver is that it uses several antennas for receiving radio-synchronous signals. Another drawback is that the resonant frequency of the selected antenna is adapted on the basis of a stored capacitive value, which means that the resonant frequency cannot be automatically adapted in accordance with the incoming signal frequency.

DE Patent No. 35 40 380 discloses a superheterodyne receiver circuit. A switch is provided at input for switching two ferrite core antennas. The input stage also includes, after the antenna, an amplifier, a quartz filter at 77.5 kHz, a mixer for mixing the signals picked up by the antenna with the signals, supplied by a quartz oscillator, which are at a frequency of around 77.283 kHz. A bandpass filter is provided at the mixer output, followed by a shaping unit for supplying time correction signals to a microcontroller connected to a timepiece quartz (32.768 kHz). One drawback of this receiver circuit is that it also includes several selectable antennas at the input thereof. Moreover, there is nothing provided for adapting the receiver circuit in accordance with the incoming radio-synchronous signal frequency.

SUMMARY OF THE INVENTION

It is thus an object of the invention to provide a radio-synchronous signal receiver of simple design, which can be automatically adapted to receive radio-synchronous signals at different frequencies with a single local oscillator stage, while overcoming the aforementioned drawbacks of the prior art.

The invention therefore concerns a radio-synchronous signal receiver for adjusting a time base, particularly of a timepiece, said receiver including an antenna for receiving radio-synchronous signals, at least one low noise amplifier for amplifying and filtering the signals picked up by the antenna, a frequency conversion unit for converting the frequency of the filtered and amplified incoming signals from the low noise amplifier, and a processing unit receiving data signals from the conversion unit for adjusting the time base, said conversion unit including:

- a local oscillator stage for supplying oscillating signals at a determined frequency;
- at least one mixer unit for mixing the filtered and amplified incoming signals with the oscillating signals supplied by the local oscillator stage, so as to generate intermediate signals whose frequency is equal to the difference between the oscillating signal frequency and a carrier frequency of the incoming signals;
- a bandpass filter for filtering the intermediate signals and
- a demodulator receiving the filtered intermediate signals and supplying the data signals at output, wherein the local oscillator stage is automatically configured by a control signal from the processing unit so that the frequency of the oscillating signals from the local oscillator stage is adapted in accordance with the frequency of the incoming radio-synchronous signals such that the intermediate signal frequency is within the bandpass filter frequency band.

Particular embodiments of the receiver are defined in the dependent claims 2 to 11.

One advantage of this type of radio-synchronous receiver according to the invention is that it can easily be configured to receive signals at various carrier frequencies. In order to do this, on the one hand, the frequency of the oscillating signals supplied by the local oscillator stage is adapted on the basis of the incoming radio-synchronous signal frequency. Thus, the intermediate signal frequency at the mixer output, which mixes the radio-synchronous signals with the oscillating signals supplied by the oscillator stage, is within the frequency band of the bandpass filter, which follows the mixer. Once the intermediate signals have been filtered and amplified to a sufficient amplitude level in the bandpass filter, the intermediate signals are demodulated in a demodulator to supply data signals to a processing unit. These data signals enable the time base of the timepiece to be corrected.

Advantageously, the local oscillator stage is a frequency synthesiser, fitted with a single timepiece quartz oscillator for supplying a reference signal in the phase lock loop, and with a voltage controlled oscillator for supplying the oscillating signals at a determined frequency.

Advantageously, once the oscillating signal frequency is adapted to the frequency of the radio-synchronous signals picked up by the antenna, the exact antenna resonant frequency can be configured by forming an LC type oscillator with the antenna. An array of switchable capacitors is placed in parallel to the antenna. The array is controlled by a configuration word supplied by a logic circuit so as to place a selected set of capacitors in parallel to the antenna for adapting the resonant frequency to the incoming radio-synchronous signal frequency.

The invention thus also concerns a method of activating a radio-synchronous signal receiver, for adjusting the time base in particular of a timepiece, the method including the initial step of converting the radio-synchronous signals picked up by the antenna into intermediate signals by mixing, in a mixer unit, the filtered and amplified incoming signals with oscillating signals supplied by the local oscillator stage, the method being wherein it includes the steps consisting in:

automatically adapting the frequency of the oscillating signals from the local oscillator stage via a control signal from the processing unit until the frequency of the intermediate signals is within the frequency band of the bandpass filter of the conversion unit, and demodulating the time data from the intermediate signals in the demodulator so as to supply data signals to the processing unit for adjusting the time base.

Particular steps of the method are defined in the dependent claims 11 to 14.

BRIEF DESCRIPTION OF THE DRAWINGS

The objects, advantages and features of the radio-synchronous signal receiver and the method of activating the receiver will appear more clearly in the following description, on the basis of at least one non-limiting embodiment illustrated by the drawings, in which.

DETAILED DESCRIPTION OF THE INVENTION

In the following description, all the components of the radio-synchronous signal receiver for adjusting the time base of a timepiece, which are well known to those skilled in this technical field, are described only in a simplified manner. Said radio-synchronous signal receiver can preferably be a superheterodyne receiver capable of picking up radio-synchronous signals at different frequencies for adjusting the time base. Said time base adjustment may be mainly for accurately correcting the time of a watch at any location, taking account of time zones, but the scope is not limited solely to this type of timepiece.

Figure 1:
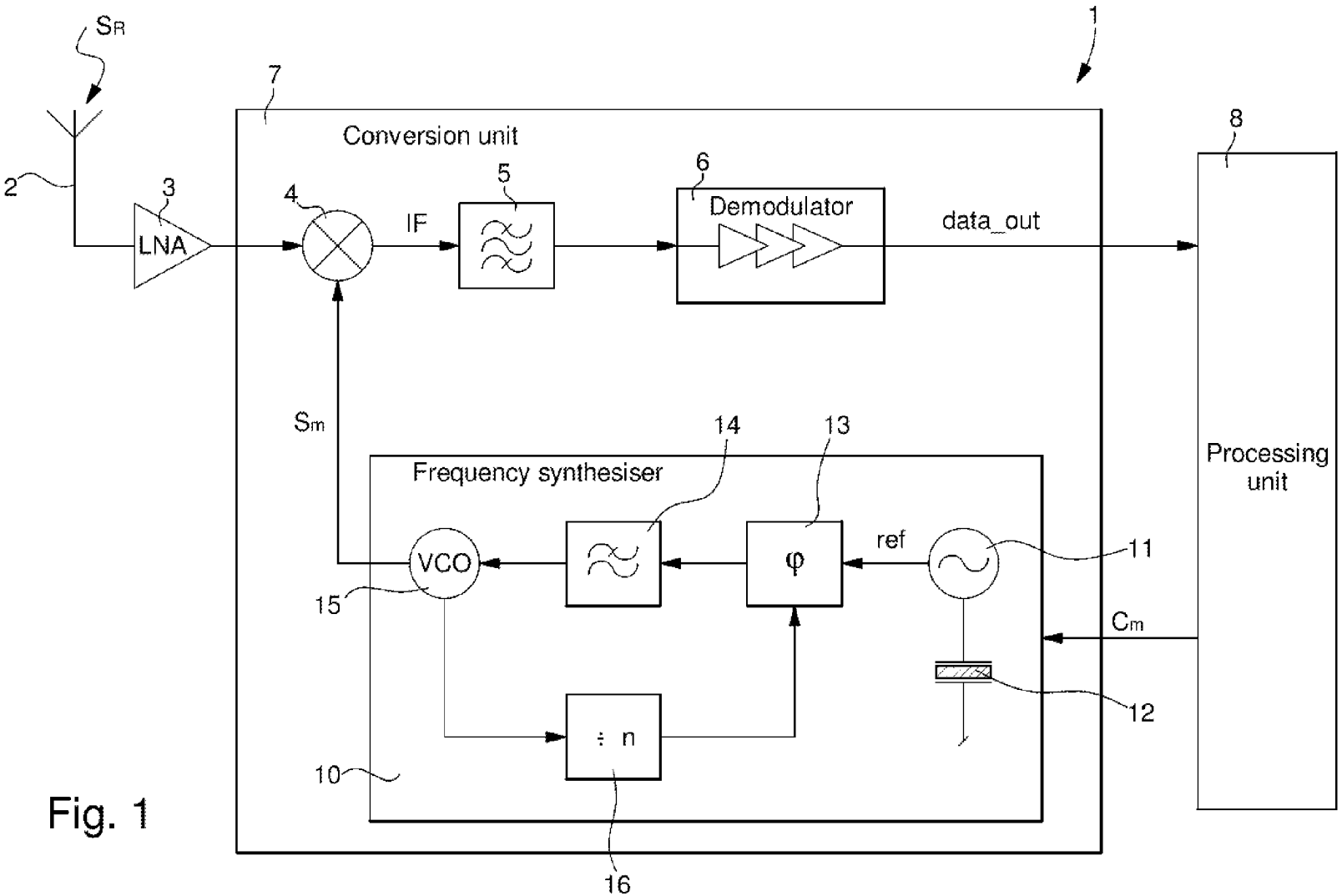
FIG. 1 shows, in a simplified manner, an embodiment of one part of the radio-synchronous signal receiver for adapting the frequency of the signal supplied by the quartz oscillator stage according to the invention.

FIG. 1 shows, in a simplified manner, the various components of multi-frequency superheterodyne receiver 1 capable of picking up radio-synchronous signals. Receiver 1 includes an antenna 2 for receiving radio-synchronous signals $S_R$, at least one LNA (low noise amplifier) 3 for amplifying and filtering the signals picked up by the antenna, a frequency conversion unit 7 for frequency converting the filtered and amplified incoming signals from the low noise amplifier, and a processing unit 8 receiving data signals data_out from the conversion unit. These data signals, which may be at several bits/sec or also at 1 bit/sec, allow the time base to be corrected via the processing unit, particularly for adjusting the time of the watch in which the receiver is placed.

Frequency conversion unit 7 includes a local oscillator stage 10 for supplying oscillating signals Sm at a determined frequency, at least one mixer unit 4 for mixing the filtered and amplified incoming signals with the oscillating signals supplied by the local oscillator stage, so as to generate intermediate signals IF, a bandpass filter 5 for filtering the intermediate signals and a demodulator 6 for demodulating the time data from the filtered intermediate signals so as to supply data signals to the processing unit. The frequency of the intermediate signals supplied by mixer unit 4 is equal to the difference between the oscillating signal frequency and a carrier frequency of the incoming radio-synchronous signals.

As the frequency of the radio-synchronous signals may be different depending upon the transmission system used, for example, from one geographical location to another, local oscillator stage 10 is automatically configured by a control signal Cm supplied by the processing unit. The frequency of oscillating signals Sm from the local oscillator stage is adapted on the basis of the incoming radio-synchronous signal frequency, such that the frequency of intermediate signals IF at the output of mixer unit 4 is within the frequency band of the bandpass filter.

The frequency of radio-synchronous signals $S_R$ picked up by antenna 2 of receiver 1 may be, for example, between 66 and 80 kHz, and preferably 77 kHz. The oscillating signals can be adapted to a frequency of around 67 kHz or 87 kHz so as to generate intermediate signals IF at a frequency of around 10 kHz, which, in this case, is the centre frequency of the bandpass filter with a bandwidth of around 2 kHz or less. However, bandpass filter 5, which is preferably a narrow band active filter, may be centred at a frequency of several kHz less, for example, than the aforementioned 10 kHz. In this case, the oscillating signal frequency must of course be adapted, so that, after mixing in mixer unit 4, the intermediate signals are at a frequency close to the central bandpass filter frequency in order to demodulate the time data properly.

Demodulator 6 may also include an RSSI type strength indicator. This indicator is capable of supplying an indication of the amplitude level of the signals filtered by the bandpass filter to processing unit 8. The processing unit, which includes configuration software, can adapt the frequency of oscillating signals Sm supplied by local oscillator stage 10 in several successive steps via control signal Cm, in accordance with said indication. The oscillating signal frequency is adapted by frequency intervals until the intermediate signal amplitude detected by the indicator is at a sufficient level for the time data to be demodulated by demodulator 6.

Local oscillator stage 10, which is adapted by control signal Cm from processing unit 8, may include a reference oscillator 11 with a single timepiece quartz 12. This reference oscillator 11 provides reference signals ref in a conventional manner at a frequency of around 32.768 kHz. Preferably, the local oscillator stage is a frequency synthesiser. This frequency synthesiser thus includes reference oscillator 11 with timepiece quartz 12 for supplying reference signal ref to a phase and frequency detector 13 in a phase lock loop. This frequency synthesiser further includes a VCO (voltage controlled oscillator) 15, which receives signals filtered by a lowpass filter 14 originating from the phase and frequency detector, so as to supply oscillating signals Sm, and a multi-mode divider 16 for dividing the oscillating signal frequency and supplying divided signals to the phase and frequency detector.

Multi-mode divider 16 of the frequency synthesiser phase lock loop is controlled by control signal Cm from the processing unit to divide the frequency of oscillating signals Sm by a time changed factor. Thus, the frequency of the oscillating signals from voltage controlled oscillator 15 is adapted over time until the frequency of intermediate signals IF is within the frequency band of bandpass filter 5. To achieve this, the processing unit may contain a well known sigma-delta type modulator for supplying a control signal Cm, with a series of modes equal to 0 or 1, to define a changed division factor of the multi-mode divider. Processing unit 8 may also include a processor for processing data and commands, an analogue-digital converter, and at least one memory for storing some calibrating frequencies in digital form, and the configuration software.

Figure 2:
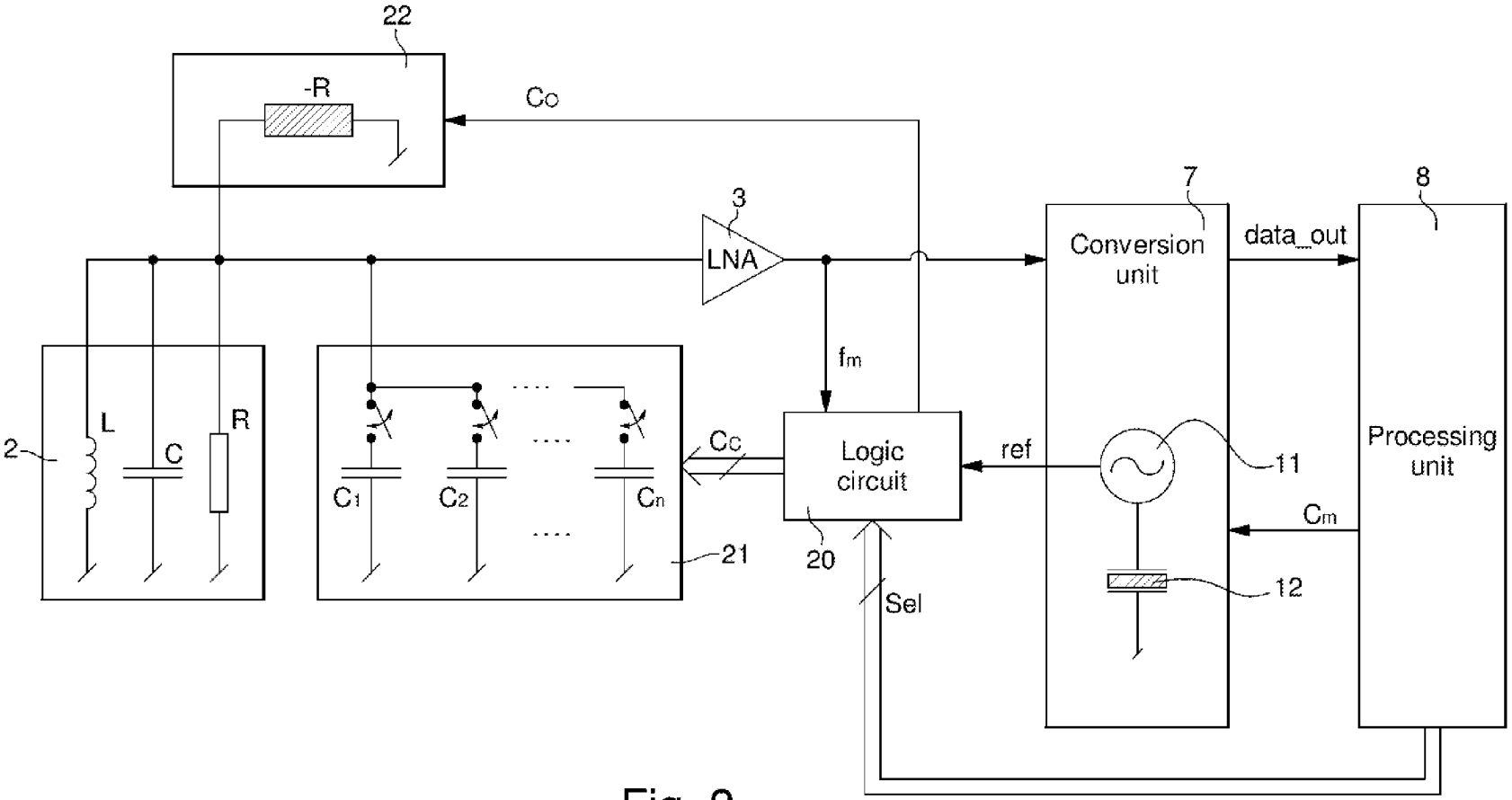
FIG. 2 shows, in a simplified manner, an embodiment of one part of the radio-synchronous signal receiver for adapting the resonant frequency of the receiver antenna according to the invention.

Once the frequency of oscillating signals Sm has been adapted or calibrated in accordance with the frequency of the incoming radio-synchronous signals $S_R$, the antenna resonant frequency can also be tuned to the frequency of the incoming radio-synchronous signals. To achieve this and as shown in FIG. 2, receiver 1 includes an array of switchable capacitors 21 placed in parallel to antenna 2 for adapting the resonant frequency in the antenna in accordance with the incoming radio-synchronous signal frequency.

Antenna 2 is usually defined by an inductance L in parallel with a capacitor C and a resistor R. The switchable capacitor array 21, placed in parallel to the antenna, is conventionally formed of several capacitors $C_1$, $C_2$ to $C_n$, wherein the capacitive value of each capacitor of the array can be weighted to the power of 2. A switch, such as an MOS transistor, is arranged in series with each corresponding capacitor $C_1$, $C_2$ to $C_n$. In order to select one capacitor or another to be placed in parallel to the antenna, the switches are controlled by a configuration word Cc with n bits, which is supplied by a logic circuit 20. In the case of switches in the form of MOS transistors, configuration word Cc is applied respectively across the gates of the MOS transistors, which is well known. This logic circuit is also operated by a frequency selection word Sel, supplied by processing unit 8 once the oscillating signal frequency has been adapted in conversion unit 7.

To adapt the resonant frequency, an LC oscillator is advantageously made with antenna 2. To achieve this, receiver 1 includes an excitation system 22, which is connected to a terminal of antenna 2 and to switchable capacitor array 21. The excitation system is switched by a power-on signal Co supplied by logic circuit 20. This excitation system preferably behaves like a negative resistor −R to form an LC oscillator with antenna 2.

Once excitation system 22 is switched on, the oscillation frequency $f_m$ of the LC oscillator is measured by the logic circuit after LNA 3. The logic circuit is clocked by a reference signal ref from a reference oscillator 11 with quartz 12, which is the quartz oscillator of conversion unit 7. To measure the oscillation frequency over a determined period, the logic circuit counts a number of the LC oscillator pulses, and a number of the reference oscillator pulses. The ratio between the number of LC oscillator pulses and the number of reference oscillator pulses allows the logic circuit to determine the oscillation frequency of the LC oscillator. A comparison can be carried out in the logic circuit with the frequency selection word Sel, supplied by the processing unit, so as to set a configuration word Cc that takes account of the resonant frequency relative to the incoming radio-synchronous signal frequency. This well established configuration word is transmitted to the array of switchable capacitors 21 for placing a selected set of capacitors in parallel to the antenna.

Once the capacitors in the switchable capacitor array 21 have been selected to determine the antenna resonant frequency, the excitation system can be disconnected to allow reception of the radio-synchronous signals.

It should be noted that all of the receiver components except antenna 2, low noise amplifier 3 and timepiece quartz 12, can be incorporated into a single integrated circuit. This integrated circuit can be made, for example, in 0.18 μm CMOS technology.

From the description that has just been given, several variants of the radio-synchronous signal receiver can be devised by those skilled in the art, without departing from the scope of the invention defined by the claims. The local oscillator stage can be an RC or other oscillator. The bandwidth or centre frequency of the bandpass filter may also be adapted.

What is claimed is:

1. A radio-synchronous signal receiver for adjusting a time base, said receiver including an antenna for receiving radio-synchronous signals, at least one low noise amplifier for amplifying and filtering the signals picked up by the antenna, a frequency conversion unit for converting the frequency of the filtered and amplified incoming signals from the low noise amplifier, and a processing unit receiving data signals from the frequency conversion unit for adjusting the time base, said frequency conversion unit including:

a local oscillator stage for supplying oscillating signals at an adapted frequency;

at least one mixer unit for mixing the filtered and amplified incoming signals with the oscillating signals supplied by the local oscillator stage, so as to generate intermediate signals whose frequency is equal to the difference between the oscillating signal frequency and a carrier frequency of the incoming signals;

a bandpass filter for filtering the intermediate signals and a demodulator receiving the filtered intermediate signals and supplying the data signals at output, wherein the local oscillator stage is automatically configured by a control signal from the processing unit so that the frequency of the oscillating signals from the local oscillator stage is adapted in accordance with the frequency of the incoming radio-synchronous signals such that the intermediate signal frequency is within the bandpass filter frequency band, and wherein the local oscillator stage is a frequency synthesiser, which includes an oscillator with a timepiece quartz for supplying a reference signal to a phase and frequency detector in a phase lock loop, a voltage controlled oscillator receiving signals filtered by a low-pass filter originating from the phase and frequency detector, so as to supply the oscillating signals, and a multi-mode divider for dividing the oscillating signal frequency and supplying divided signals to the phase and frequency detector.

2. The receiver according to claim 1, wherein the local oscillator stage includes a reference oscillator with a single timepiece quartz.

3. The receiver according to claim 1, wherein the multi-mode divider of the frequency synthesiser phase lock loop is controlled by the control signal from the processing unit, so as to divide the frequency of the oscillating signals by a time changed factor to adapt the frequency of the oscillating signals from the voltage controlled oscillator.

4. The receiver according to claim 1, wherein the bandpass filter is a narrow band active bandpass filter centered on a frequency close to 10 kHz with a bandwidth of around 2 kHz or less.

5. The receiver according to claim 1, wherein the demodulator includes a strength indicator for the intermediate signals, which is able to provide an indication of the amplitude of the signals filtered by the bandpass filter to the processing unit, and wherein the processing unit includes configuration software for adapting the frequency of the oscillating signals supplied by the local oscillator stage, via the control signal, until the intermediate signal amplitude detected by the indicator is at a sufficient level to allow the demodulator to demodulate the time data.

6. The receiver according to claim 1, wherein it includes an array of switchable capacitors placed in parallel to the antenna for adapting the antenna resonant frequency in accordance with the incoming radio-synchronous signal frequency, selection of the capacitors from the array to be placed in parallel to the antenna being controlled by a configuration word supplied by a logic circuit, and wherein the logic circuit is controlled by a frequency selection word supplied by the processing unit to adapt the antenna resonant frequency.

7. The receiver according to claim 6, wherein it includes an excitation system, connected to a terminal of the antenna and to the switchable capacitor array, the excitation system being controlled by a power-on signal from the logic circuit to form an LC oscillator with the antenna, the oscillation frequency of the LC oscillator being measured by the logic circuit, and wherein the logic circuit supplies a configuration word to the switchable capacitor array taking account of the frequency selection word and the measured oscillation frequency, so as to adapt the antenna resonant frequency by placing a selected set of capacitors in parallel to the antenna.

8. The receiver according to claim 7, wherein the logic circuit is switched on by the processing unit, wherein the logic circuit is clocked by a reference oscillator with a timepiece quartz, wherein the logic circuit is arranged for measuring, over a certain period of time, a number of the LC oscillator pulses and a number of the reference oscillator pulses to determine the oscillation frequency of the LC oscillator.

9. The receiver according to claim 8, wherein the reference oscillator with a timepiece quartz forms part of the local oscillator stage of the frequency conversion unit.

10. The method of activating a radio-synchronous signal receiver for adjusting a time base, said receiver including an antenna for receiving radio-synchronous signals, at least one low noise amplifier for amplifying and filtering the signals picked up by the antenna, a frequency conversion unit for converting the frequency of the filtered and amplified incoming signals from the low noise amplifier, and a processing unit receiving data signals from the frequency conversion unit for adjusting the time base, said frequency conversion unit including:

a local oscillator stage for supplying oscillating signals at an adapted frequency;

at least one mixer unit for mixing the filtered and amplified incoming signals with the oscillating signals supplied by the local oscillator stage, so as to generate intermediate signals whose frequency is equal to the difference between the oscillating signal frequency and a carrier frequency of the incoming signals;

a band-pass filter for filtering the intermediate signals and a demodulator receiving the filtered intermediate signals and supplying the data signals at output, the method including the initial step of converting the radio-synchronous signals picked up by the antenna into intermediate signals by mixing, in a mixer unit, the filtered and amplified incoming signals with oscillating signals supplied by the local oscillator stage, wherein the method includes the following steps:

automatically adapting the frequency of the oscillating signals from the local oscillator stage via a control signal from the processing unit until the frequency of the intermediate signals is within the frequency band of the band-pass filter of the conversion unit, and demodulating the time data from the intermediate signals in the demodulator so as to supply data signals to the processing unit for adjusting the time base.

11. The method according to claim 10, wherein during the step of adapting the oscillating signal frequency, the demodulator supplies an indication of the amplitude of the filtered intermediate signals to the processing unit to enable said processing unit, which includes configuration software, to adapt the oscillating signal frequency successively via the control signal, until the amplitude of the intermediate signals detected by the demodulator indicator is at a sufficient level for the demodulator to demodulate the time data.

12. The method according to claim 10, wherein once the oscillating signal frequency has been adapted in accordance with the frequency of the radio-synchronous signals picked up by the antenna to obtain intermediate signals with sufficient amplitude, the resonant frequency of the antenna is adapted to the incoming radio-synchronous signal frequency by placing a selected set of capacitors of a switchable capacitor array in parallel to the antenna, said array being controlled by a configuration word from a logic circuit dependent upon a frequency selection word supplied by the processing unit.

13. The method according to claim 12, wherein the logic circuit supplies a power-on signal to an excitation system, which is connected to a terminal of the antenna and the switchable capacitor array to form an LC oscillator with the antenna, the oscillation frequency of the LC oscillator being measured by the logic circuit to supply a configuration word to the switchable capacitor array taking account of the frequency selection word to adapt the resonant frequency automatically by placing the selected set of capacitors in parallel to the antenna.

14. The method according to claim 13, wherein while the resonant frequency is being adapted at the level of the antenna, the oscillation frequency is measured in the logic circuit by counting a number of the LC oscillator pulses and a number of pulses of a reference oscillator , which clocks the logic circuit, over a certain period of time, and the ratio between the number of the LC oscillator pulses and the number of the reference oscillator pulses determining the oscillation frequency of the LC oscillator to define the configuration word, taking account of the frequency selection word.

15. A radio-synchronous signal receiver for adjusting a time base, said receiver including an antenna for receiving radio-synchronous signals, at least one low noise amplifier for amplifying and filtering the signals picked up by the antenna, a frequency conversion unit for converting the frequency of the filtered and amplified incoming signals from the low noise amplifier, and a processing unit receiving data signals from the frequency conversion unit for adjusting the time base, said frequency conversion unit including:

a local oscillator stage for supplying oscillating signals at an adapted frequency;

at least one mixer unit for mixing the filtered and amplified incoming signals with the oscillating signals supplied by the local oscillator stage, so as to generate intermediate signals whose frequency is equal to the difference between the oscillating signal frequency and a carrier frequency of the incoming signals;

a band-pass filter for filtering the intermediate signals and a demodulator receiving the filtered intermediate signals and supplying the data signals at output, wherein the local oscillator stage is automatically configured by a control signal from the processing unit so that the frequency of the oscillating signals from the local oscillator stage is adapted in accordance with the frequency of the incoming radio-synchronous signals such that the intermediate signal frequency is within the band-pass filter frequency band, and wherein the demodulator includes a strength indicator for the intermediate signals, which is able to provide an indication of the amplitude of the signals filtered by the band-pass filter to the processing unit, and wherein the processing unit includes configuration software for adapting the frequency of the oscillating signals supplied by the local oscillator stage, via the control signal, until the intermediate signal amplitude detected by the indicator is at a sufficient level to allow the demodulator to demodulate the time data.

* * * * *